US005482489A

United States Patent [19]

Stone

[11] Patent Number: 5,482,489

[45] Date of Patent: Jan. 9, 1996

[54] FOLDING ASSEMBLED ARTICLE, SUCH AS A TOY AIRPLANE, WITH LOCKING MEMBER

[75] Inventor: Myron Stone, Weehawken, N.J.

[73] Assignee: Dipco Products Company, Inc., Hackensack, N.J.

[21] Appl. No.: 334,149

[22] Filed: Nov. 4, 1994

[51] Int. Cl.[6] ..... A63H 27/00

[52] U.S. Cl. ..... 446/67; 446/488

[58] Field of Search ..... 446/50, 55–68, 446/488, 80

[56] References Cited

U.S. PATENT DOCUMENTS

| | | | |
|---|---|---|---|
| 1,348,373 | 8/1920 | Pierce | 446/67 |
| 1,408,001 | 2/1922 | Hauck | 446/67 X |
| 1,420,194 | 6/1922 | Howard | 446/67 |
| 1,599,280 | 9/1926 | Lewis | 446/62 |
| 2,168,653 | 8/1939 | Meagher, Jr. | 446/67 |
| 2,505,541 | 4/1950 | Guillow | 446/67 |
| 3,729,862 | 5/1973 | Halsey | 446/67 |
| 3,885,343 | 5/1975 | Fields | 446/64 |
| 4,103,454 | 8/1978 | Stone | 446/67 |
| 4,301,614 | 11/1981 | Newton | 446/68 |
| 4,642,062 | 2/1987 | Dorffler | 446/68 |

*Primary Examiner*—Mickey Yu
*Attorney, Agent, or Firm*—Samuelson & Jacob

[57] ABSTRACT

A folding assembled article in the form of a toy airplane has a fuselage of paper folded along a longitudinal line, a paper wing assembled with the fuselage and movable between a folded configuration, wherein the assembly is flat for packaging purposes, and an erect configuration, wherein the wing is in an extended lateral position relative to the fuselage for flight, and a locking member for locking the wing in the extended lateral position against inadvertent return to the folded configuration.

10 Claims, 3 Drawing Sheets

FOLDING ASSEMBLED ARTICLE, SUCH AS A TOY AIRPLANE, WITH LOCKING MEMBER

The present invention relates generally to articles constructed of assembled members of sheet material, such as paper, and pertains, more specifically, to a folding assembly, such as a toy airplane, capable of folding flat for packaging and ready erection for use.

In U.S. Pat. No. 4,103,454, there is disclosed a paper article in the form of a paper airplane capable of being folded to a flat configuration and selectively erected to an operating configuration. The disclosed paper airplane has attained widespread acceptance and has exhibited exemplary performance over a number of years. The present invention is an improvement over the invention disclosed in U.S. Pat. No. 4,103,454, the substance of which patent is incorporated herein by reference thereto.

In the construction set forth in the aforesaid U.S. Pat. No. 4,103,454, the wing of the airplane is unfolded so that the wing halves extend in generally opposite directions and are maintained in that position by upward bowing of the wing at the fold line between the wing halves. While such bowing of the wing has proved to be adequate to maintain the wing erect for appropriate performance of the airplane during the normally expected service life of the toy, experience has shown that over an extended period of time, after many cycles of folding and unfolding of the wing, the locking mechanism provided by bowing of the wing is weakened, with the result that collapse of the wing during use of the airplane becomes possible. In order to assure that the wing remains locked in the erect position, even after long-term use of the toy, and under even more severe operating conditions, the present improvement provides a supplemental locking arrangement for more positively locking the wing in the erect position. As such, the present invention attains several objects and advantages, some of which are summarized as follows: Provides an assembled article constructed of sheet material, such as a toy airplane, capable of folding and ready erection with increased ease and effectiveness; establishes a more positive locking arrangement for maintaining the article erect during use, even after many cycles of folding and unfolding and under more rigorous operating conditions; provides a paper airplane construction of increased strength and more stable performance under a wider variety of operating conditions; adds to the aesthetic appearance of an already popular toy paper airplane; increases the effective service life of a toy paper airplane already known for high quality and exemplary performance.

The above objects and advantages, as well as further objects and advantages, are attained by the present invention which may be described briefly as a folding assembly, such as a toy airplane, capable of being folded to a flat configuration and selectively erected to an operating configuration, the assembly comprising: a longitudinally extending first member of sheet material folded along a longitudinal line into a pair of juxtaposed side-by-side parts; a pair of curved slots in the first member, the curved slots being located one in each of said parts so as to be juxtaposed with one another in the folded first member; a second member of sheet material passing through the juxtaposed slots and having a fold line located between the side-by-side parts and aligned longitudinally parallel to the longitudinal line in the first member, the fold line dividing the second member into sections, the sections being movable between a first position, wherein the sections are relatively flat and folded into juxtaposition with one another along the fold line in the second member, and a second position wherein the sections extend in generally opposite directions from the fold line therein, and portions of the sections adjacent the slots, including a portion containing the fold line, are curved to conform generally to the curve of the slots; a slot passing through the second member and extending longitudinally along the fold line in the second member; and a third member of sheet material, the third member including a retainer extending through the slot and a longitudinally extending shoulder overlying the second member adjacent the slot such that upon movement of the sections of the second member into the second position thereof, the retainer is engagable with the second member to maintain the shoulder against the second member adjacent the slot and lock the sections of the second member in the second position against inadvertent return toward the first position.

The invention will be understood more fully, while still further objects and advantages will become apparent, in the following detailed description of a preferred embodiment of the invention illustrated in the accompanying drawing, in which.

Figure 1:
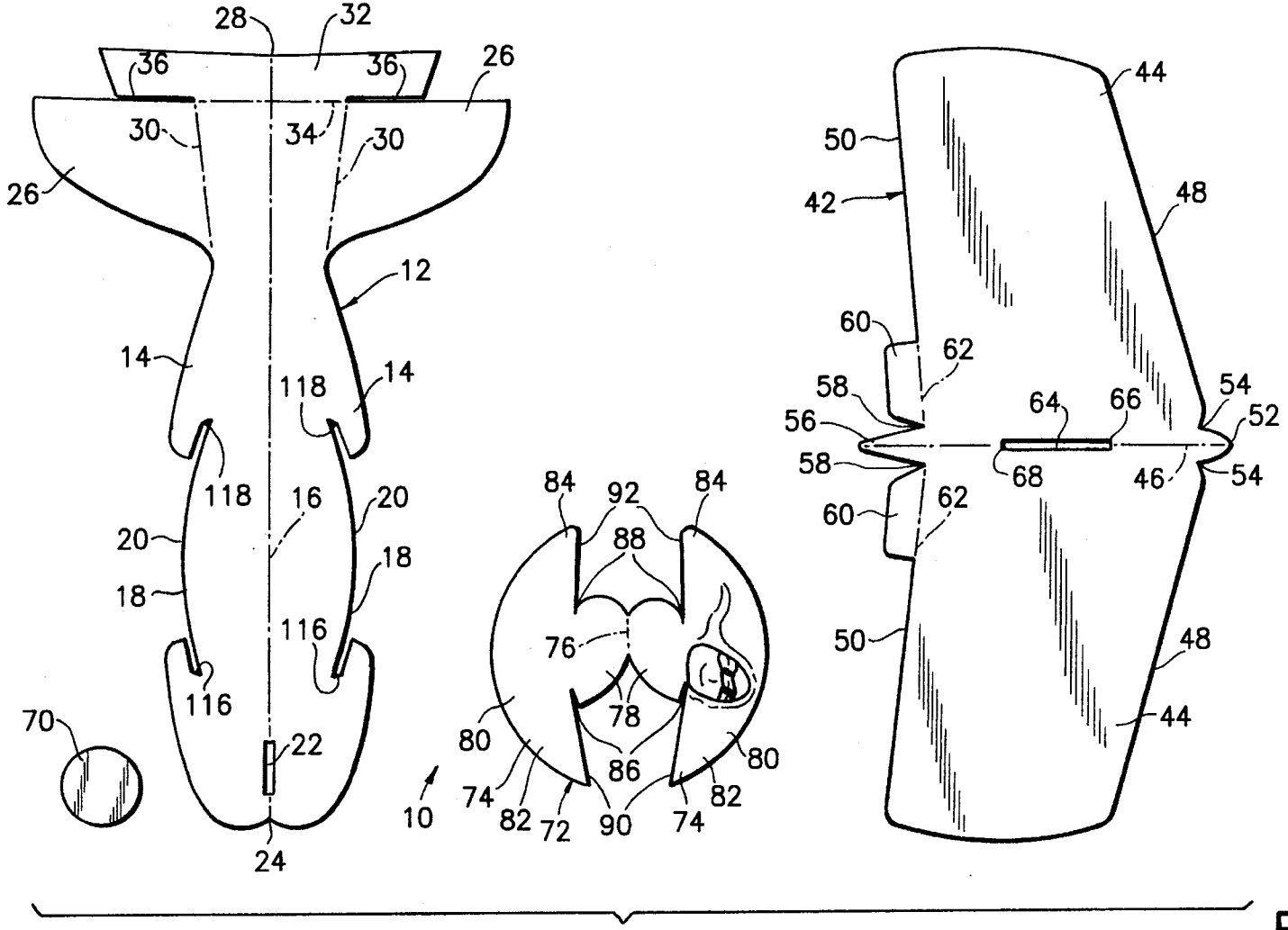
FIG. 1 is a plan view of the component parts of a toy paper airplane constructed in accordance with the present invention, prior to assembly of the airplane.

Referring now to the drawing, and especially to FIG. 1 thereof, a toy paper airplane which will be constructed in accordance with the invention is illustrated generally at 10 in the form of individual component parts to be assembled.

A first member 12 is divided into symmetric parts 14 by a longitudinal fold line 16. Each part 14 includes a curved slot 18 which, in this instance, is open at the top 20 of the curve of the slot 18. An aperture 22 is placed along the fold line 16 adjacent the front or nose end 24 of first member 12, and lateral extensions 26 project from parts 14 adjacent the back or tail end 28 of first member 12, a fold line 30 being placed between each extension 26 and the corresponding part 14. A rear-most portion 32 is located between a lateral score line 34 and the back end 28 and is separated from lateral extensions 26 by slits 36.

A second member 42 is divided into symmetric sections 44 by a fold line 46. Each section 44 has a leading edge 48 and a trailing edge 50. A forward projection 52 extends forward of leading edges 48 and is bounded by forward notches 54, each spaced laterally from fold line 46. A rearward projection 56 extends rearward of trailing edges 50 and is bounded by rearward notches 58, each spaced laterally from fold line 46. Adjacent each rearward notch 58 is a flap 60 extending rearwardly from each trailing edge 50 and contiguous therewith along a score line 62. A slot 64 is coextensive with the fold line 46, intermediate the leading edges 48 and the trailing edges 50, and extends longitudinally between a leading end 66, adjacent the leading edges 48, and a trailing end 68, adjacent the trailing edges 50. A disk 70, preferably of metal, will serve as a weight to balance the assembled airplane for flight.

A third member 72 is divided into symmetric parts 74 by a longitudinal fold line 76. Each part 74 includes tab portions 78 and head portions 80 having leading arm portions 82 and trailing arm portions 84. A notch portion 86 extends longitudinally into each part 74 of the third member 72, each notch portion 86 extending longitudinally between the leading arm portion 82 and the tab portion 78 of the respective part 74. A slot portion 88 extends longitudinally into each part 74 of the third member 72, each slot portion 88 extending longitudinally between the trailing arm portion 84 and the tab portion 78 of the respective part 74. Each leading arm portion 82 has a locking edge portion 90 and each trailing arm portion 84 has a locking edge portion 92.

First, second and third members 12, 42 and 72 are die cut from paper sheet stock in a conventional manner, with slots 18, aperture 22 and slits 36, slot 64 and notches 54 and 58, and notch portions 82 and slot portions 88 all being formed in the die cutting operation in the conventional manner.

Figure 2:
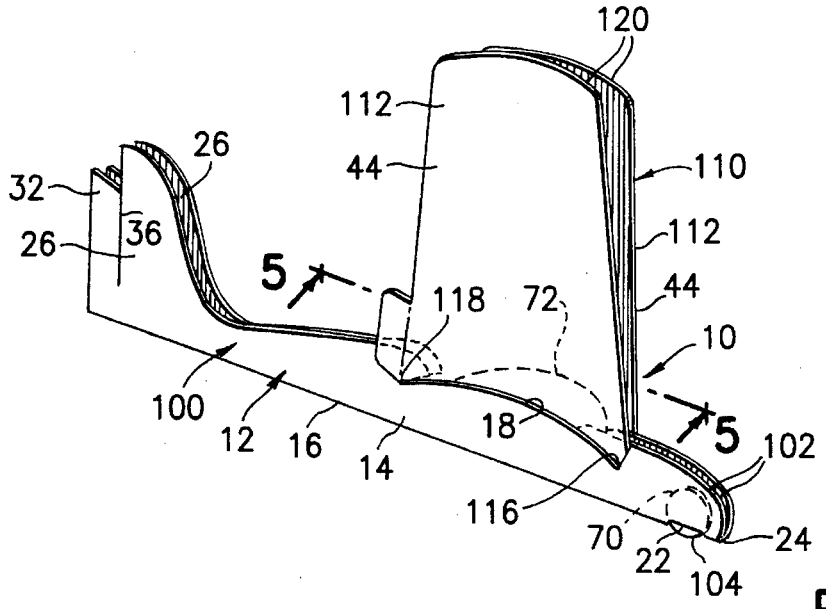
FIG. 2 is a perspective view of the airplane assembled and in folded configuration.
Figure 3:
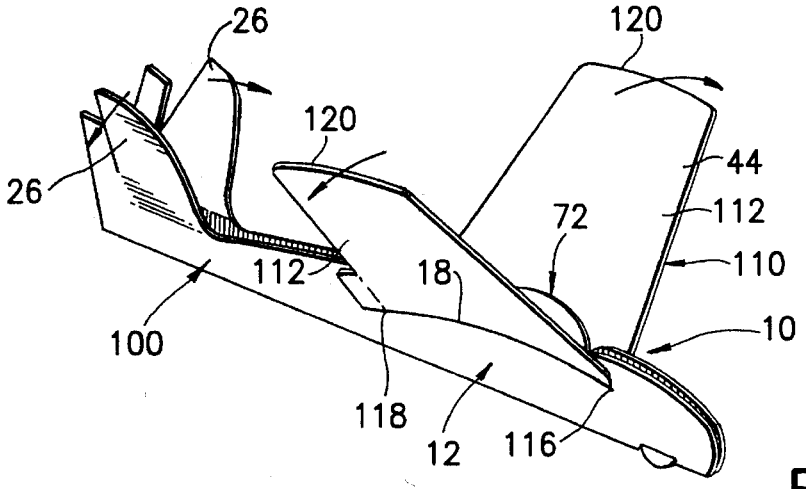
FIG. 3 is a perspective view of the assembled airplane in an intermediate configuration.
Figure 4:
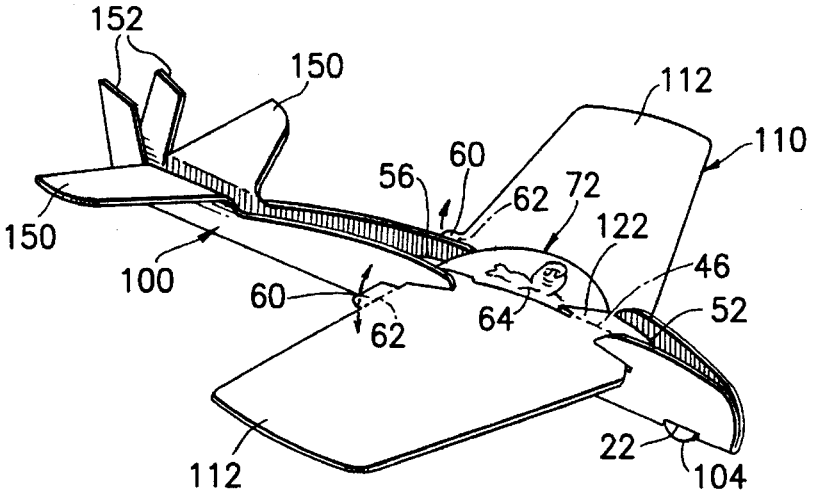
FIG. 4 is a perspective view of the assembled airplane in an erect, but not yet fully locked, configuration.

Turning now to FIGS. 2, 3 and 4, airplane 10 is assembled by folding first member 12 along fold line 16 so that parts 14 are juxtaposed with one another in side-by-side relationship to establish a fuselage 100. Disk 70 is placed in aperture 22 and, preferably, a small amount of adhesive (not shown) is applied between the disk 70 and the corresponding nose portions 102 of the parts 14 to secure the disk 70 in place within the nose portion of the fuselage 100 and to maintain the parts 14 in the folded configuration. It is noted that placement of the disk 70 within the aperture 22 serves to locate the disk 70 accurately relative to the fuselage 100, by virtue of the accuracy with which aperture 22 can be die cut, so that appropriate balance is assured. Accurate location of disk 70 also provides the appropriate balanced forward thrust upon launching airplane 10 for proper flying characteristics. Furthermore, the relative dimensions of aperture 22 and disk 70 enable the disk 70 to protrude downwardly from fuselage 100, thereby providing a landing skid 104 at the most advantageous location in fuselage 100.

Upon folding first member 12 along fold line 16, slots 18 are juxtaposed with one another. Second member 42 is then located within the slots 18 so as to extend laterally from the fuselage 100 and establish a wing 110, each section 44 representing a wing half 112. Third member 72 is folded about fold line 76 and the tab portions 78 establish a retainer in the form of a tab 114 (see FIG. 5) which is inserted into slot 64, but is not passed completely through second member 42. Each forward notch 54 is engaged with a forward end 116 of a corresponding slot 18, while each rearward notch 58 is engaged with a rearward end 118 of a corresponding slot 18 to secure wing 110 in place within fuselage 100. The slots 18 are bowed so that the ends 116 and 118 of each slot 18 are closer to fold line 16 than the top 20 of that slot 18. The wing halves 112 are folded about central fold line 46, which now is aligned longitudinally parallel to fold line 16 and lies below the slots 18, between the slots 18 and the fold line 16, so that the wing halves 112 are brought into a first position wherein the wing halves 112 are flat and in juxtaposition with one another, as seen in FIG. 2. In such folded configuration, airplane 10 is completely assembled but is in a flat state suitable for packaging in a simple envelope or a like package for storage, distribution and sale.

In order to erect airplane 10 for use, the wing 110 is unfolded, preferably by grasping the wing tips 120 and moving the wing halves 112 about fold line 46, as seen in FIG. 3, until the wing halves 112 extend in generally opposite directions from fold line 46, which is raised to become aligned generally with slots 18, as seen in FIG. 4. Since the length of each slot 18, along the curve between the forward and rearward ends 116 and 118 of each slot 18, is about equal to the length of the wing halves 112 between the forward and rearward notches 54 and 58, at least that portion of the wing 110 at the slots 18 will conform to the curvature of the slots 18, causing the central portion 122 of the wing 110, and the fold line 46 therein, to bow upwardly. At the same time, the parts 14 of the fuselage 100 in the vicinity of slots 18 are spread apart somewhat by virtue of the location of forward notches 54 at either side of forward projection 52 and the location of rearward notches 58 at either side of rearward projection 56. The upward bowing of the wing 110 at the fold line 46 will secure the wing in the conformed configuration, thereby maintaining the wing halves 112 in the second position against inadvertent return toward the first, or folded, position. In other words, the bow in the portion 122 of the wing 110 which includes the fold line 46 tends to preclude inadvertent folding of the wing halves 112 about the fold line 46.

Figure 5:
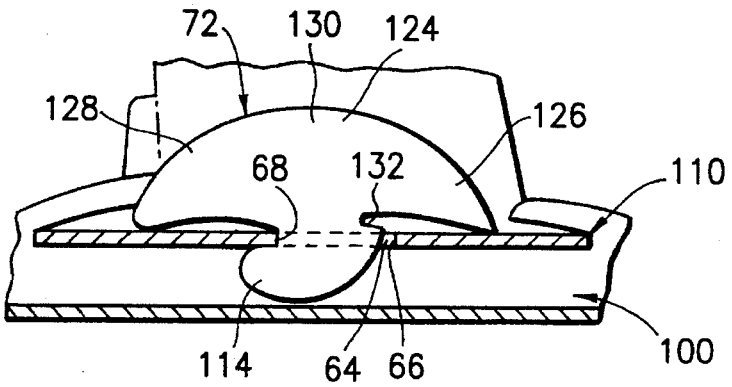
FIG. 5 is an enlarged, fragmentary cross-sectional view taken along line 5—5 of FIG. 2.
Figure 6:
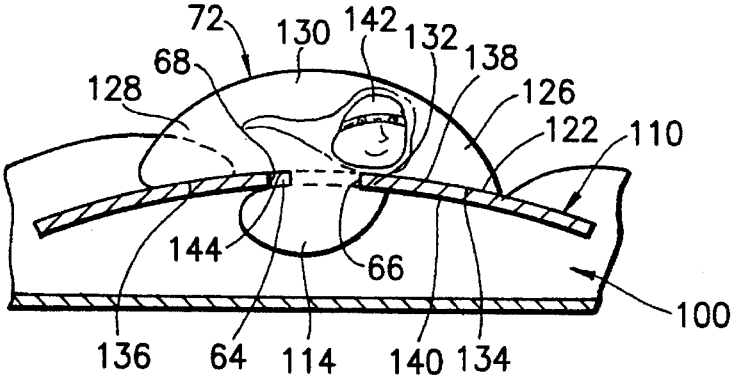
FIG. 6 is an enlarged, fragmentary cross-sectional view similar to FIG. 5, but showing the component parts in a fully-locked configuration.

However, experience has shown that over an extended period of time, after many cycles of folding and unfolding of the wing 110, the locking mechanism provided by bowing of the wing 110 at portion 122 is weakened, with the result that collapse of the wing 110 during use of the airplane 10 becomes possible. In order to assure that the wing 110 remains locked in the erect position, even after long-term use of the toy, and under even more severe operating conditions, the present improvement provides a supplemental locking arrangement including a locking member for more positively locking the wing 110 in the erect position. Thus, upon unfolding of wing 110, a head 124, established by the head portions 80 of third member 72, is grasped, at a finger-grip 130 provided adjacent leading and trailing arms 126 and 128, respectively, established by the corresponding leading and trailing arm portions 82 and 84, along the extended area of head 124, and tab 114 is pushed through slot 64, as illustrated in FIGS. 5 and 6. In FIG. 5, third member 72 is shown in the position occupied by the third member 72 when the airplane 10 is in the folded, or collapsed configuration illustrated in FIG. 2. Upon erection of the airplane 10, as described above in connection with FIGS. 3 and 4, third member 72 is exposed for grasping, tab 114 is pushed fully through slot 64 in wing 110, and the third member 72 is moved forward so that the leading end 66 of the slot 64 is received within a notch 132, established by notch portions 86, between tab 114 and leading arm 126 of head 124. In that forward position of third member 72, as illustrated in FIG. 6, the third member 72 is secured in place, by virtue of the interengagement of notch 132 and the wing 110 at the leading end 66 of slot 64. A shoulder in the form of a locking edge 134, established by locking edge portions 90 along each leading arm 126, and a further shoulder in the form of a locking edge 136, established by locking edge portions 92 along each trailing arm 128, each have a contour configuration complementary to the bowed shape of the wing 110 along the corresponding length of bowed portion 122 so that upon locking the third member 72 in place, as shown in FIG. 6, the arms 126 and 128 of the third member 72 engage upper surface 138 of the wing 110, while the tab 114 engages lower surface 140 of the wing 110 to maintain the bowed contour of the bowed portion 122 against collapse. In addition to providing finger-grip 130, the upwardly-directed area of head 124 establishes a vertical fin for increased stability of the airplane 10 in flight. As an added feature, the head 124 preferably is provided with a profile contour configuration simulating a cockpit canopy and carries a depiction of a pilot in the cockpit, as indicated at 142.

Figure 7:
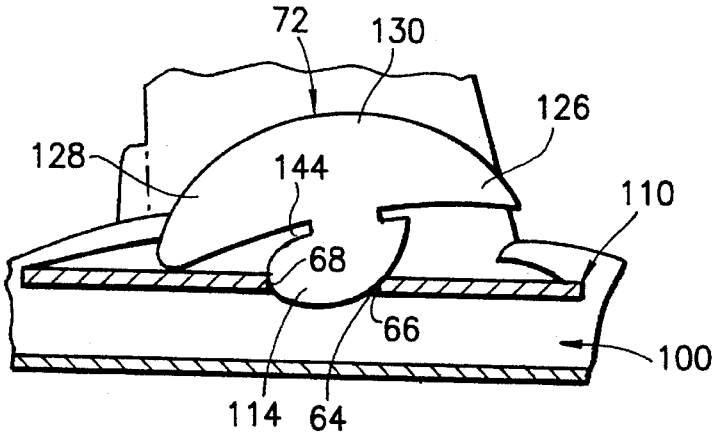
FIG. 7 is a similar enlarged, fragmentary cross-sectional view illustrating initial insertion of a locking member of the assembled toy paper airplane.

The assembly of third member 72 with second member 42 is facilitated by the shape of the tab 114 and the provision of a slot 144, established by slot portions 88, extending between the trailing arm 128 and the tab 114. Turning now to FIG. 7, tab 114 is provided with a rounded contour configuration at the trailing edge 146 of the tab 114 so that upon insertion of the leading edge 148 of the tab 114 into the slot 64, the third member 72 merely is rotated and pulled back, such backward displacement being permitted by the entry of the trailing end 68 of slot 64 into slot 144. Once fully seated, with tab 114 extending fully through slot 64, the third member 72 may be moved forward into the locked position illustrated in FIG. 6.

It will be apparent that the airplane 10 is readily erected for flight, once it is removed from its package, by merely grasping the wing tips 120 and pulling gently to open the wing 110 to the fully erect laterally extended position. The wing 110 then is locked in the fully erect position by pushing the third member 72 home into the locking position. The lateral extensions 26 are then folded down to establish horizontal stabilizers 150, while rear-most portion 32 provides vertical stabilizers 152, and the airplane 10 is ready for use. The entire erection procedure can be reversed for storage of the airplane 10. Thus, by releasing the third member 72 and then pressing downwardly upon the central portion 122 of the wing 110, and upon fold line 46, the wing 110 again can be flattened and folded about the fold line 46 to return to the position illustrated in FIG. 2. By virtue of the positive locking arrangement provided by the locking member in the form of third member 72, the re-folding can be repeated over many cycles of operation without degrading the performance of the airplane 10.

When erected for flight, the flight configuration of airplane 10 may be modified selectively to alter the flight characteristics of the airplane 10. Thus, flaps 60 may be raised or lowered by bending each flap 60 about the respective score line 62. In executing a banking turn for a circular return flight, the flaps 60 may be lowered to shorten the radius of the circular flight or raised to lengthen the radius.

It will be seen that the improvement of the present invention attains the several objects and advantages summarized above, namely: Provides an assembled article constructed of sheet material, such as a toy airplane, capable of folding and ready erection with increased ease and effectiveness; establishes a more positive locking arrangement for maintaining the article erect during use, even after many cycles of folding and unfolding and under more rigorous operating conditions; provides a paper airplane construction of increased strength and more stable performance under a wider variety of operating conditions; adds to the aesthetic appearance of an already popular toy paper airplane; increases the effective service life of a toy paper airplane already known for high quality and exemplary performance.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A folding assembly capable of being folded to a flat configuration and selectively erected to an operating configuration, the assembly comprising:

a longitudinally extending first member of sheet material folded along a longitudinal line into a pair of juxtaposed side-by-side parts;

a pair of curved slots in the first member, the curved slots being located one in each of said parts so as to be juxtaposed with one another in the folded first member;

a second member of sheet material passing through the juxtaposed slots and having a fold line located between the side-by-side parts and aligned longitudinally parallel to the longitudinal line in the first member, the fold line dividing the second member into sections, the sections being movable between a first position, wherein the sections are relatively flat and folded into juxtaposition with one another along the fold line in the second member, and a second position wherein the sections extend in generally opposite directions from the fold line therein, and portions of the sections adjacent the slots, including a portion containing the fold line, are curved to conform generally to the curve of the slots;

a slot passing through the second member and extending longitudinally along the fold line in the second member; and a third member of sheet material, the third member including a retainer extending through the slot and a longitudinally extending shoulder overlying the second member adjacent the slot such that upon movement of the sections of the second member into the second position thereof, the retainer is engagable with the second member to maintain the shoulder against the second member adjacent the slot and lock the sections of the second member in the second position against inadvertent return toward the first position.

2. The invention of claim 1 wherein the retainer includes a tab for insertion into the slot, an arm carrying the shoulder, and a notch located between the tab and the arm for receiving the second member between the tab and the arm to secure the third member in place within the slot of the second member.

3. The invention of claim 2 wherein:

the folding assembly is a toy airplane;

the first member is a fuselage extending longitudinally between a nose portion and a tail portion;

the second member is a wing extending longitudinally between a leading edge and a trailing edge and laterally between opposite wing tips, when the sections of the second member are in the second position, and includes an upper surface and a lower surface, and the sections are wing halves; and the tab is located altitudinally below the second member while the arm is located altitudinally above the second member such that the tab confronts the lower surface of the wing and the shoulder confronts the upper surface of the wing.

4. The invention of claim 3 wherein the arm includes a lower edge along the shoulder, the lower edge having a contour configuration curved to generally complement the curve of the portion along the fold line in the second member.

5. The invention of claim 4 wherein the slot is located intermediate the leading edge and the trailing edge of the second member, the slot including a leading end adjacent the leading edge and a trailing end adjacent the trailing edge.

6. The invention of claim 5 wherein the third member has a leading edge juxtaposed with the leading end of the slot and a trailing edge juxtaposed with the trailing end of the slot, the arm extends longitudinally from the leading edge of the third member toward the trailing edge of the third member, and the notch is located at the leading edge of the third member to receive the leading end of the slot.

7. The invention of claim 6 wherein the retainer includes a further arm extending longitudinally from the trailing edge of the third member toward the leading edge of the third member, the further arm including a further shoulder overlying the second member adjacent the trailing end of the slot, and a further slot in the retainer between the further shoulder and the tab for receiving the trailing end of the slot of the second member within the further slot in the retainer upon displacement of the retainer in the direction from the leading edge of the second member toward the trailing edge of the second member.

8. The invention of claim 7 wherein the further arm includes a lower edge along the further shoulder, the lower edge having a contour configuration curved to generally complement the curve of the portion along the fold line in the second member.

9. The invention of claim 8 wherein the retainer includes a finger-grip portion adjacent the arm and the further arm.

10. The invention of claim 9 wherein the third member has a fold line dividing the third member into a pair of juxtaposed side-by-side parts, each part including a tab portion, arm portions, notch portions and slot portions for establishing said tab, said arm, said further arm, said notch and said slot upon folding the third member along the fold line.

* * * * *